US009913024B2

(12) United States Patent
Lage et al.

(10) Patent No.: US 9,913,024 B2
(45) Date of Patent: Mar. 6, 2018

(54) ACOUSTIC RESISTIVE ELEMENTS FOR PORTED TRANSDUCER ENCLOSURE

(71) Applicant: Bose Corporation, Framingham, MA (US)

(72) Inventors: Antonio M. Lage, Ashland, MA (US); Said Boluriaan, Acton, MA (US); Eric C. Mitchell, Upton, MA (US); Ray Scott Wakeland, Marlborough, MA (US); John H. Wendell, Westford, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 14/981,546

(22) Filed: Dec. 28, 2015

(65) Prior Publication Data

US 2017/0188135 A1 Jun. 29, 2017

(51) Int. Cl.
*H04R 1/28* (2006.01)
*H04R 1/02* (2006.01)

(52) U.S. Cl.
CPC ..... *H04R 1/288* (2013.01); *H04R 1/2819* (2013.01); *H04R 1/2826* (2013.01); *H04R 1/2849* (2013.01); *H04R 1/2857* (2013.01); *H04R 1/2888* (2013.01); *H04R 1/021* (2013.01); *H04R 2201/02* (2013.01)

(58) Field of Classification Search
CPC . H04R 1/2811–1/2826; H04R 1/2838–1/2857; H04R 1/2869–1/2896; H04R 1/227; H04R 1/345; H04R 1/347; H04R 1/403; H04R 2201/40–2201/405; H04R 2203/12
See application file for complete search history.

(56) References Cited

U.S. PATENT DOCUMENTS

| | | | | |
|---|---|---|---|---|
| 3,047,090 | A | 7/1962 | Pruden | |
| 5,208,868 | A | 5/1993 | Sapiejewski | |
| 5,479,520 | A * | 12/1995 | Nieuwendijk | H04R 1/2842 181/160 |
| 6,389,146 | B1 * | 5/2002 | Croft, III | H04R 1/2842 381/345 |
| 7,565,948 | B2 | 7/2009 | Parker et al. | |
| 8,295,526 | B2 | 10/2012 | Bastyr et al. | |
| 8,351,630 | B2 | 1/2013 | Ickler et al. | |

(Continued)

FOREIGN PATENT DOCUMENTS

EP 1 585 108 10/2005

OTHER PUBLICATIONS

International Search Report and Written Opinion; PCT/US2016/065362; dated Mar. 24, 2017.

*Primary Examiner* — Joshua Kaufman
(74) *Attorney, Agent, or Firm* — Fish & Richardson P.C.

(57) ABSTRACT

An apparatus includes an enclosure capable of receiving a transducer for converting electrical signals into audible signals. The apparatus also includes one or more structures within the enclosure defining one or more channels, each channel having one end located within the enclosure and another end that is external to the enclosure. The apparatus also includes an acoustic resistive element located in the one of the one or more structures, the acoustic resistive element being capable of changing the acoustic characteristics of at least one of the one or more channels within the enclosure.

25 Claims, 6 Drawing Sheets

(56) References Cited

U.S. PATENT DOCUMENTS

| | | | | |
|---|---|---|---|---|
| 8,358,798 | B2 | 1/2013 | Ickler et al. | |
| 2004/0005069 | A1* | 1/2004 | Buck | H04R 1/30 381/336 |
| 2005/0094837 | A1* | 5/2005 | Parker | H04R 9/022 381/355 |
| 2005/0129258 | A1* | 6/2005 | Fincham | H04S 1/002 381/160 |
| 2014/0093113 | A1 | 4/2014 | Dix et al. | |

* cited by examiner (b)

(a)

ACOUSTIC RESISTIVE ELEMENTS FOR PORTED TRANSDUCER ENCLOSURE

TECHNICAL FIELD

This document relates to transducer enclosures, in particular, designs to improve the acoustical performance of ported transducer enclosures.

BACKGROUND

Loudspeakers can be considered as including at least two primary components: a transducer that converts electrical signals into mechanical motion, and an enclosure designed to convert mechanical motion into radiated sound. While some enclosures are sealed, other enclosure designs include a port that allows air to pass between the interior and exterior of the enclosure. By incorporating a port, smaller enclosures can be produced that are efficient (in terms of the sound radiated for a given electrical power input), and more sensitive (in terms of the sound radiated for a given electrical signal input) relative to sealed enclosures.

SUMMARY

The disclosure provides a technique to improve the acoustical performance of a ported speaker enclosure by reducing noise through the introduction of an acoustic resistive element into a channel included in the ported enclosure. By positioning the element into a structure that connects a portion of a port channel to the exterior of the enclosure, another portion of the port channel, another channel, etc., unwanted acoustic effects of the port, which can interfere with the audible output of the ported enclosure, can be reduced.

In one aspect, an apparatus includes an enclosure capable of receiving a transducer for converting electrical signals into audible signals. The apparatus also includes one or more structures within the enclosure defining one or more channels, each channel having one end located within the enclosure and another end that is external to the enclosure. The apparatus also includes an acoustic resistive element located in the one of the one or more structures, the acoustic resistive element being capable of changing the acoustic characteristics of at least one of the one or more channels within the enclosure.

Implementations may include one or more of the following features. The acoustic resistive element may allow air flow between the channel and another channel included in the enclosure. The channel may be adjacent to the other channel. The acoustic resistive element may allow air flow between the channel and the exterior of the enclosure. The acoustic resistive element may allow air flow between the channel and an acoustic volume defined by the enclosure. The acoustic resistive element may be configured to change the acoustical signature of a port that includes the at least one of the one or more channels within the enclosure. The acoustic resistance element includes a single layer. The acoustic resistance element may include multiple layers. The acoustic resistance element may include a layer of fabric material. The acoustic resistance element may include a metallic mesh. The acoustic resistance element may be generally rectangular in shape.

In another aspect, an apparatus includes a transducer for converting electrical signals into audible signals. The apparatus also includes an enclosure that includes the transducer. One or more structures within the enclosure defining one or more channels, each channel having one end located within the enclosure and another end that is external to the enclosure. The apparatus also includes an acoustic resistive element located in the one of the one or more structures, the acoustic resistive element being capable of changing the acoustic characteristics of at least one of the one or more channels within the enclosure.

Implementations may include one or more of the following features. The acoustic resistive element may allow air flow between the channel and another channel included in the enclosure. The channel may be adjacent to the other channel. The acoustic resistive element may allow air flow between the channel and the exterior of the enclosure. The acoustic resistive element may allow air flow between the channel and an acoustic volume defined by the enclosure. The acoustic resistive element may be configured to change the acoustical signature of a port that includes the at least one of the one or more channels within the enclosure. The acoustic resistance element may include a single layer. The acoustic resistance element may include multiple layers. The acoustic resistance element may include a layer of fabric material. The acoustic resistance element may include a metallic mesh. The acoustic resistance element may be generally rectangular in shape.

Other features and advantages will be apparent from the description and drawings, and from the claims.

DESCRIPTION OF DRAWINGS

Like reference symbols in the various drawings indicate like elements.

DETAILED DESCRIPTION

Figure 1:
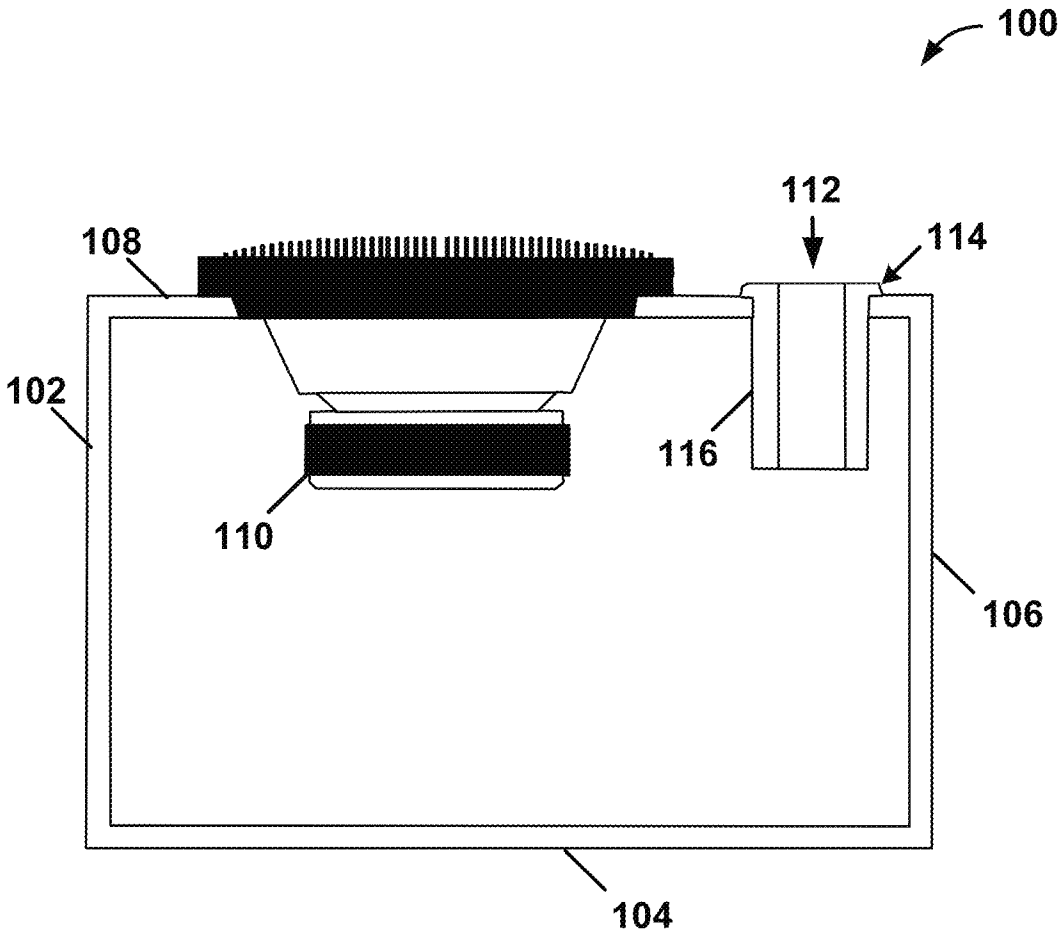
FIG. 1 is a cross sectional view of a ported transducer enclosure.

Referring to FIG. 1, a cross sectional view of a ported enclosure 100 of a loudspeaker is presented that includes four walls 102, 104, 106, 108 that generally define the structure of the enclosure. In this arrangement, a transducer that converts electrical signals into audible signals (transducer 110) is mounted into the upper wall 108; however, the transducer may be oriented differently in other examples. To allow air to freely flow between the acoustic volume defined by the enclosure 100 and the environment of the exterior of the enclosure, a port 112 is incorporated into the upper wall 108 of the enclosure. In this particular example the port is realized by a cylindrical structure; however, other designs (e.g., different shapes, cross sections, etc.) may be employed. In general, the port 112 includes a port interface 114 that allows air to enter the port from the ambient environment and to exit the port. The port 112 also includes a port channel 116 that directs the air into and out of the acoustic volume or interior of the enclosure.

In general, ports can have undesirable acoustical attributes that enclosure designs may address (e.g., minimize) to provide appropriate performance and still be relatively small in size. By allowing air flow through the port, unwanted noise and distortion of the sound being produced can be created. For example, the geometry of the port (e.g., port channel length) can produce acoustic standing waves that may alter the desired frequency response of the loudspeaker by introducing resonances, reinforcing noise and/or distortion, etc. through excitation of the standing waves. In arrangements in which the volume of the port is considerable portion of the entire enclosure volume (e.g., port volume is 50% or more of the enclosure volume), standing waves in the port can occur at frequencies that are within the operating band of the loudspeaker (that includes the port and the transducer). Through controlling techniques (e.g., damping), their corrupting effects can be reduced. Additionally, by properly dampening of such standing waves, the waves and/or resonances can be exploited to improve (e.g., increase) the output, efficiency, etc. of the loudspeaker.

The introduction of computer-aided modeling and design, computational analysis (e.g., finite element analysis), advanced manufacturing processes and materials, etc. have allowed ported enclosures to be designed with higher levels of quality and improved frequency responses compared to sealed enclosure designs. Along with the layout of the enclosure itself (e.g., transducer location, etc.) and other design parameters (e.g., enclosure size, materials employed such as wall linings, etc.), the design of the port to allow air flow (to and from the acoustic volume of the enclosure) can affect the overall performance of the loudspeaker.

As mentioned above, the port 112 can contribute to noise being added output of the loudspeaker (that includes the enclosure 100 and the transducer 110). In particular, both the port interface 114 and the port channel 116 can cause the introduction of resonances, standing waves, etc., that may be considered noise sources. For example, resonant tones may be excited by the port interface's structure, the structure of the port channel, etc. Such noise tones can be particularly distracting to a listener when the spectral range of the audible content being played back by the speaker includes the frequencies of the resonant tones. For example, the bass tones of the content may be affected by the tonal resonance, standing waves, etc. and thereby corrupt playback. Along with affecting the performance of a single transducer enclosure, the performance of an enclosure containing multiple transducers may be degraded. Other types of enclosures may also be affected in similar manners. For example, waveguide type enclosures can be considered as a port that consumes nearly the entire volume of the enclosure (e.g., a small percentage of an enclosure, 10%, is used by the transducer or transducer in the enclosure). Similar to the illustrated enclosure, standing waves may form in waveguide enclosures and potentially corrupt the output of the loudspeaker. Examples of such waveguides are described in U.S. Pat. No. 7,565,948, entitled "Acoustic Waveguiding," and U.S. Pat. No. 8,295,525, entitled "Low Frequency Enclosure for Video Display Devices," both of which are incorporated by reference in their entirety, herein.

Figure 2:
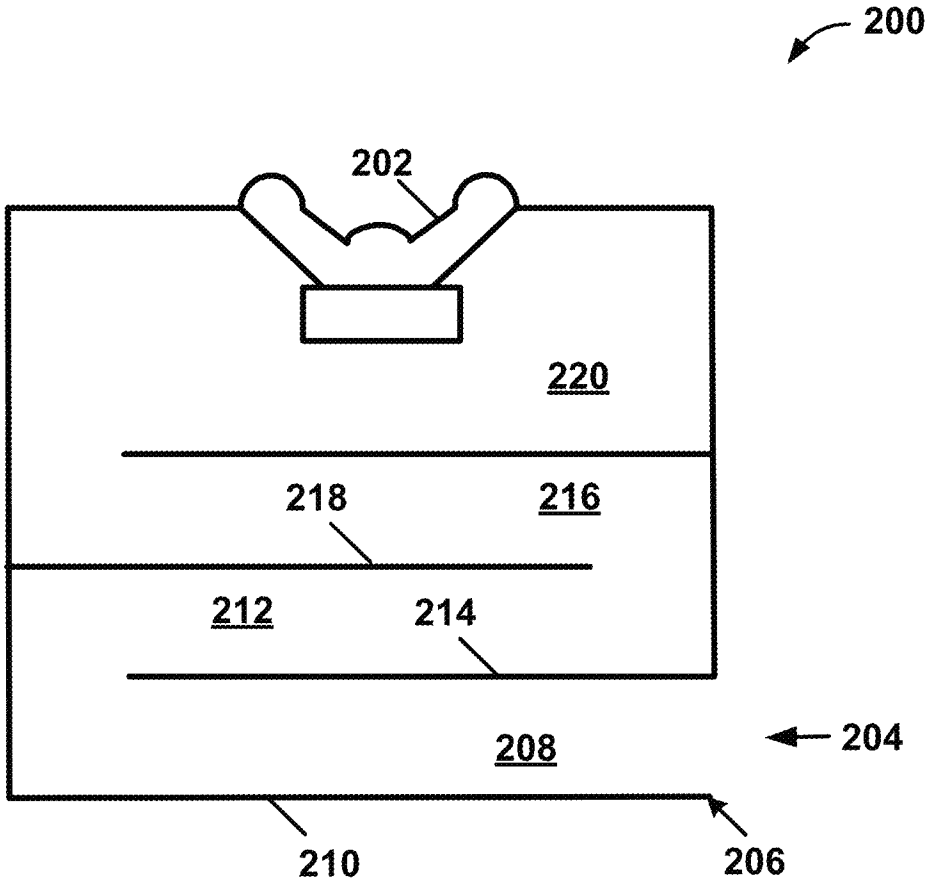
FIG. 2 is a graphical representation of a ported transducer enclosure with a winding port channel.

Referring to FIG. 2, a graphical representation illustrates the cross section of another transducer enclosure design. In this example, an enclosure 200 includes a transducer 202 and a relatively more complex port (compared to the cylindrical shaped port 112 of FIG. 1). A port 204 includes a port channel that includes a series of segments that produce a pathway that alternate in direction. In this example, a port interface 206 (that interfaces the port 204 of the enclosure to the exterior environment) is followed by a first segment 208 of the port channel and extends from right to left along a back wall 210 of the enclosure. After a 180 degree turn, a second segment 212 of the port channel of the port 204 extends along the first segment 208 (in the opposite direction). Being adjacent, the two segments 208 and 212 share a common wall structure 214 within the acoustic volume of the enclosure. After another turn, another segment 216 of the port channel extends along the second segment 212, and shares another common wall structure 218. After the last turn, the port opens into a cavity 220 that contains the transducer 202. Similar to the cylindrical port interface 114 and channel 116 (shown in FIG. 1), the overlapping segment design of the port 204 (e.g., the port interface 206, the multiple segments of the port channel) can be a noise source capable of limiting the output performance of the transducer 202 under operation. For example, standing waves may form in the port 204 for some frequencies (e.g., tens of hertz) based upon the movement of the air within the open-ended channel created by the port. The acoustic effects of such standing waves may appear at frequencies that are also included in the spectrum of the playback content, thereby potentially corrupting the listening experience.

Figure 3:
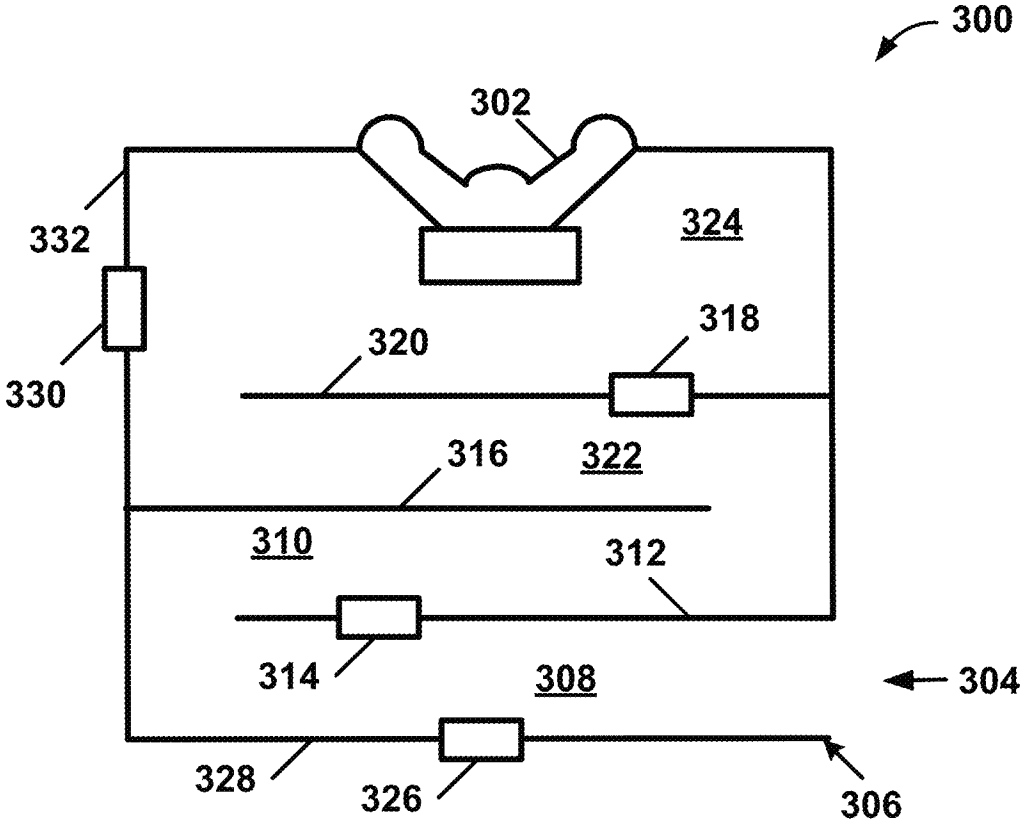
FIG. 3 is a graphical representation of a ported transducer enclosure including acoustic resistive elements connecting various portions of the transducer enclosure.

Referring to FIG. 3, one or more techniques may be implemented to reduce the effects of overlapping segments of a port channel (and other port portions) from corrupting the acoustics of an enclosed speaker. For example, one or more elements that reduce acoustical effects may be incorporated into a structure (e.g., wall) that is shared by segments of the port channel. An enclosure 300 is illustrated that includes a transducer 302 and a port 304 that includes a port interface 306 and a port channel defined by overlapping segments in which adjacent segments share a common structure. For example, port segments 308 and 310 share a common wall structure 312. To reduce the effects of one or more standing waves that form due the structure, acoustical characteristics, etc. of the port 304, a resistive acoustic element 314 is incorporated into this shared structure 312 to reduce the acoustic resonant features of the port interface 306, the port channel (e.g., segments 308, 310), etc. In this illustration, the geometry (e.g., size, shape, etc.) of the element 314 was selected to visually highlight the element. For example, the element 314 is illustrated as extending outward from both surfaces of the wall structure 312; however, the geometry of the element may be designed such that the element is substantially flush to one or both wall surfaces. For example, the element 314 may be a screen incorporated into the wall. In general, a screen can be considered relatively thin, rigid material through which air can pass. To reduce potentially corrupting acoustical effects, the sound pressure difference across the element may be low (e.g., the difference between the sound pressure present at the element 314 in segment 308 and the sound pressure at the element in segment 310). In some arrangements in which one or more waveguides provide a channel, to reduce the effects of one or more standing waves, a resistive acoustic element 314 can be incorporated into this shared structure (e.g., a wall structure shared between two waveguides, shared between two portions of a waveguide, shares between a waveguide and the acoustic volume of an enclosure or exterior of an enclosure, etc.) to reduce the resonant features of the waveguide, the enclosure, etc.

In this illustrated example, a single acoustic resistive element is incorporated into the wall 312; however additional elements may similarly be incorporated into the wall. Also, one or more resistive elements may be incorporated into other structures of the port channel segments; for example, one or multiple resistive elements may be included in shared wall structure 316. In combination with one or more elements being incorporated into a shared wall, a resistive element (or multiple resistive elements) may be incorporated into one structure (or multiple structures) of the enclosure that is not shared by two or more segments of the port channel. For example, a resistive element 318 may be incorporated in wall structure 320 that is shared by channel segment 322 and an interior portion of the enclosure (e.g., a cavity 324 within which the transducer 302 is mounted). One or more elements can be incorporated into an exterior wall structure (e.g., wall 320) of the enclosure 300. For example, a resistive element 326 may be incorporated into a wall structure 328 that is shared by the port channel 308 and the exterior of the speaker enclosure 300. Similar positions on each wall structure may be selected for incorporating such resistive elements, or, different position locations may be selected for two or more elements. For example, one or more resistive elements (e.g., element 330) can be incorporated into a wall structure 332 (of the enclosure 300) that is shared by the enclosure's exterior and the cavity 324 within which the transducer 302 is mounted.

Various types of design parameters of the elements may be adjusted to reduce potentially corrupting acoustical characteristics of various portions of the enclosure (e.g., a port, a cavity within the enclosure, a wall structure, etc.). For example, the geometry (e.g., size, shape, etc.) of one or more elements may be adjusted. Similarly the orientation of the elements (as embedded in wall structures) may be adjusted (e.g., translated, rotated, etc.) individually or in concert (e.g., to create particular patterns) to address certain resonance effects.

Various types of structures may be employed for producing one or more resistive elements. For example, a single layer element (e.g., a single layer screen) or a multi-layer element (e.g., stacked screens) may be designed and used. For a multi-layer resistive element, one or more separation distances (e.g., between screens) may be employed for the design. Further, air may be allowed to flow between the multiple layers. Further, one or more materials may be used to create structures between the screens. For example, different patterns (e.g., ridges, channels, etc.) may be incorporated into structures positioned between the layers created by the multiple screens. Such screens can also incorporate one or more geometries (e.g., rectangular shapes, etc.). Resistive elements may be designed to connect (allow air flow) between enclosure portions that are not adjacent. For example, one or multiple three dimensional structures (e.g., tubes) may be used to connect non-adjacent port channels, cavities and volumes within the enclosure, exterior walls of the enclosure, etc.

Various types of materials may be used for producing resistive elements to dampen potentially corrupting effects of acoustical characteristics of ports, surfaces, and other portions of a transducer enclosure. For example, one or more screens included in the resistive element 314 may be metallic in composition and include one or more metals (along with other types of materials in some arrangements). A substantially solid metal layer (or layers) may be used to produce a screen. Meshes and other types of pattern designs may be employed in one or more screens. One or more fabrics may be employed in the resistive element; for example, a relatively stiff fabric may be used that is capable to withstanding the environmental effects (e.g., temperatures, sound pressures, vibrations, etc.) of the speaker enclosure 300. Composite materials may also be used to create a screen, a screen frame, or other structural components of the resistive element 314. Combinations of different materials may also be used for producing components of the resistive element 314; for example, one or more composites (e.g., plastics) and metals may be employed.

Figure 4:
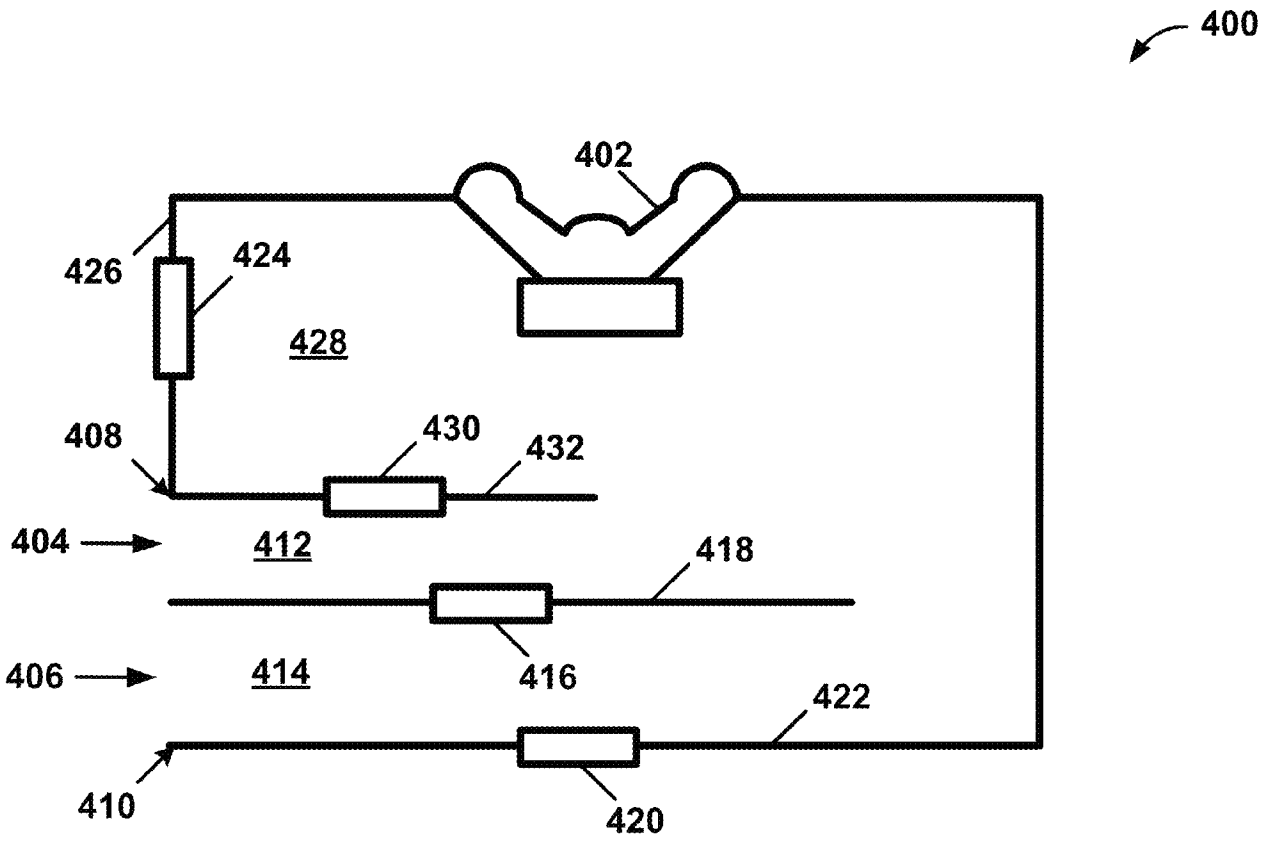
FIG. 4 is a graphical representation of a ported speaker enclosure including an acoustic resistive element being shared by multiple ports.

Referring to FIG. 4, some ported transducer enclosure designs may include multiple ports and one or more resistive elements may similarly be incorporated in a structural component being shared by two or more of these multiple ports. In this illustrated example, a speaker enclosure 400 (that includes a transducer 402) includes two separate ports 404 and 406 that allow air to flow between the exterior of the enclosure and the acoustic volume of the enclosure. Similar to other ports presented in FIGS. 1-3, both of the ports 404 and 406 include port interfaces (e.g., port interfaces 408 and 410) and port channels (e.g., port channels 412 and 414). The structure and design of the port interfaces 408 and 410 can result in noise sources (e.g., over a range of frequencies) that may corrupt the acoustical characteristics of the enclosure. Similarly, the port channels 412 and 414 (of the respective ports 404 and 406) may have acoustical signatures that could potentially corrupt the audible output of the transducer 402 and enclosure 400. To reduce these potentially corrupting acoustic effects of the port interfaces and port channels, one or more acoustic resistive elements may be incorporated into a structure that is shared by the two independent ports. For example, as shown in the figure, an acoustic resistive element 416 is incorporated into a wall structure 418 that is shared by both of the port channels 412 and 414. For visual highlighting, the resistive element 416 is graphically represented as extending outward from both surfaces of the wall structure 418. Similar to the previously described designs, the resistive element 416 may be a screen, a stack of screens (e.g., a multi-screen design), etc. that is flush to the surfaces of both sides of the wall structure. As mentioned above, the resistive element may incorporate a variety of designs, or use various design parameters (e.g., geometries, materials, orientations, positioning), etc. While one resistive element is incorporated in the wall structure 418 in this example, additional resistive elements can be incorporated in the wall structure 418 shared by the two ports 404 and 406. For example, multiple resistive elements (e.g., oriented in a particular pattern) can be incorporated (e.g., embedded) in the wall. Along with at least one resistive element being incorporated into a shared wall structure (or other type of structural component shared by the ports), one or more resistive elements may be incorporated at other locations of the speaker enclosure; for example, a resistive element may be incorporated into a structural wall that is not shared by the two ports. In the illustrated arrangement, a resistive element 420 may be incorporated into a wall structure 422 that is shared by a port (e.g., port 406) and the exterior of the enclosure 400. One or more resistive elements may also be incorporated into a wall structure that is not used to define a port; for example, a one or more resistive elements (e.g., resistive element 424) may be embedded into a wall structure 426 that separates the exterior of the enclosure 400 and a cavity 428, which includes the transducer 402. This design also illustrates a resistive element 430 incorporated into a wall structure 432 that is shared by a port (i.e., the port 412) and the cavity 428 that contains the transducer 402. By incorporating such resistive elements throughout the enclosure (e.g., at various locations), and employing different designs, design parameters, etc. the effects of potentially corrupting acoustical signatures can be reduced and thereby improve the audible content output of the transducer 402 and the enclosure 400.

Figure 5:
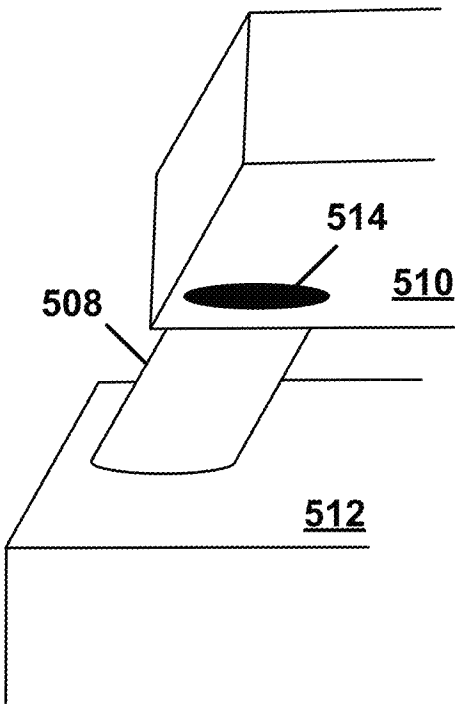
FIG. 5 is a graphical representation of acoustic resistive element geometries.
Figure 5:
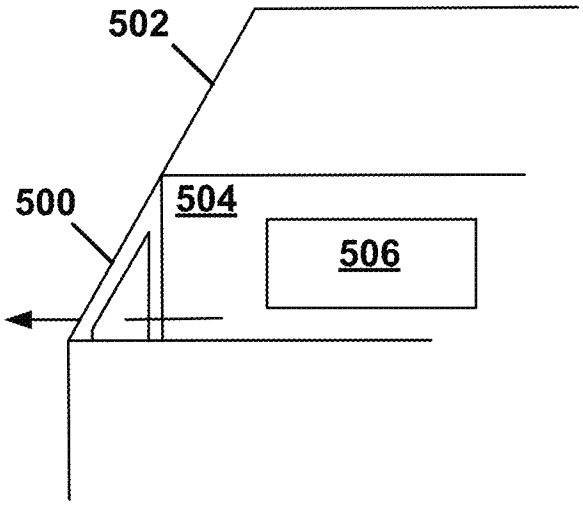

Referring to FIG. 5, two example implementations of acoustic resistive elements are graphically presented. FIG. 5(*a*) illustrates structures that define two adjacent port channels that share a wall structure with an embedded acoustic resistive element. In particular, a port channel 500 is located adjacent to another port channel 502 and a wall structure 504 is shared by the two channels. In this illustration an upper wall for port channel 500 has been removed to expose structures that define the inner portion of the channel. In particular, a screen 506 is embedded into the shared wall structure 504 to reduce sound pressure being experienced along the side of screen 506 exposed to port channel 500 and the side of the screen exposed to port channel 502. As mentioned above, such a screen can also be positioned in other structures of a loudspeaker enclosure (e.g., an exterior wall structure that is shared by a channel port, a wall structure shared by other portions of transducer enclosure, etc.).

Referring to FIG. 5(*b*), other types of structures can be employed to introduce an acoustic resistive element between portions of a loudspeaker enclosure. In this illustrated example, a tubular structure is used to connect two port channels 510 and 512 within a transducer enclosure that do not share a common wall structure (e.g., the channels are separated and slightly translated). In some arrangements, one or more screens may be included in the tubular structure 508; for example, a screen 514 may be positioned substantially flush to one of the channels (e.g., the lower wall of port channel 510). Similarly, a screen may be positioned substantially flush to the other channel (e.g., the upper wall of channel 512). As mentioned above, multiple screens may be employed; for example, two or more screens may be incorporated into the tubular structure 508 to provide an acoustic resistive element. Also mentioned above with respect to other arrangements, other portions of a transducer enclosure may be connected by such a tubular structure or other type of structure (e.g., having a similar geometry, a different geometry such as rectangular, etc.).

Figure 6:
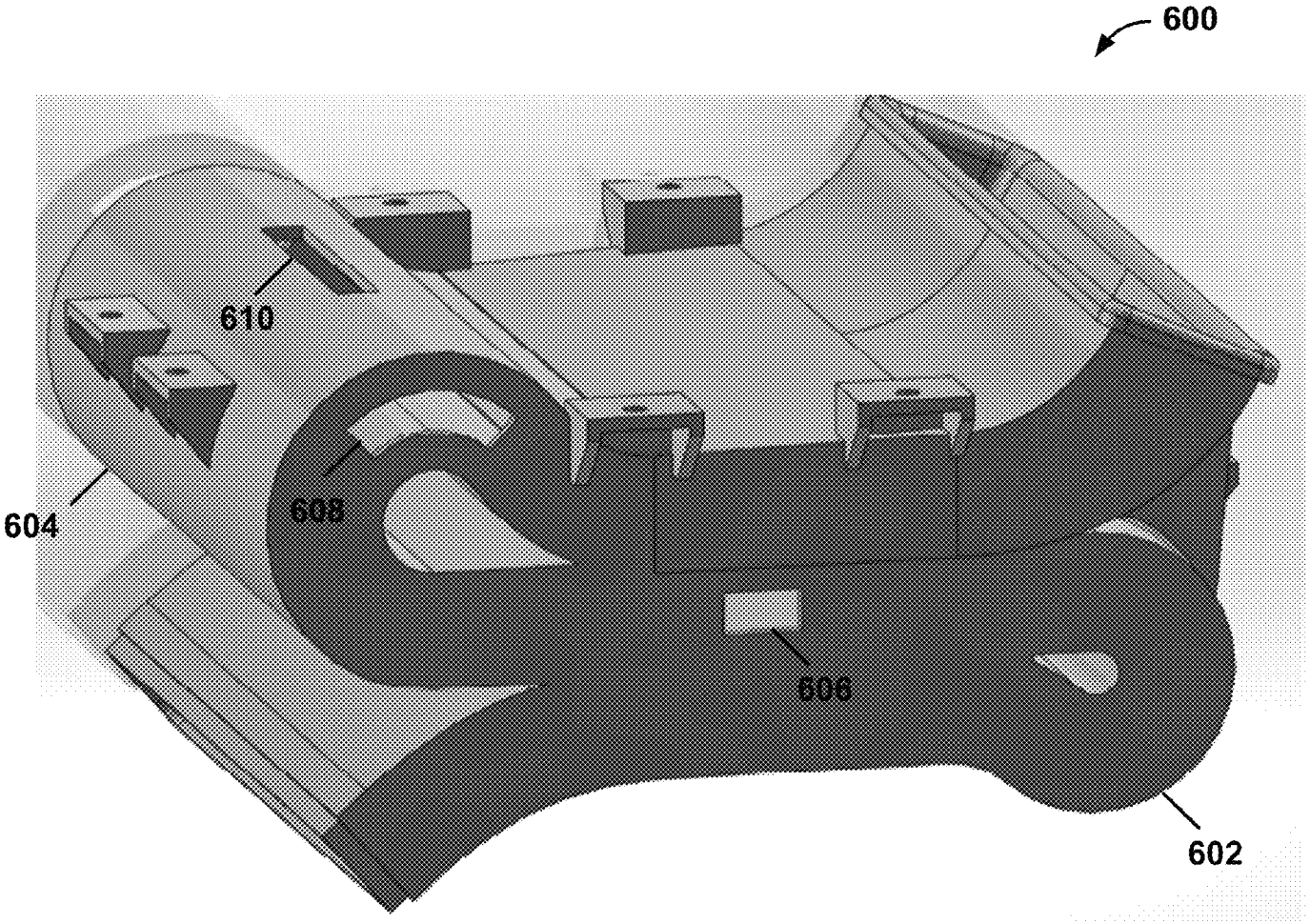
FIG. 6 is a three dimensional view of a port channel.

Referring to FIG. 6, a three-dimensional representation of a port channel 600 is presented with a relatively more complex geometry (in comparison to channels presented in FIGS. 2-5). By incorporating an arched segment 602, the path of the channel turns 180 degrees before another arched segment 604 returns the direction of the channel's path by using other 180 degree turn. In this particular port channel, two windows 606 and 608 are cut into a side wall of the channel for acoustic resistive elements. Additionally, another window 610 is cut into an upper wall of the channel. In some arrangements, a screen may be inserted into either or both of the side wall positioned windows (e.g., an arched shaped screen is inserted into window 608, and, a rectangular shaped screen is inserted into window 606) to provide an acoustic resistive element. In such a scenario, each screen would allow air flow between the port channel and the acoustic volume of the enclosure that the channel resides. Similarly, one or more screens (or other type of resistive element) may be incorporated into the upper wall positioned window 610; however, some designs may not include such a window being incorporated into a port channel. In some arrangements, the windows may remain open (and no screens are inserted) to allow air flow and reduce sound pressure between the channel and the acoustic volume of the enclosure. Further, while this particular design does not include one or more resistive elements being positioned in a structure (e.g., wall structure) being shared by two port channels, two portions of a port channel, etc., such a resistive element or elements may be incorporated in some arrangements to reduce the effects of potentially corrupting standing waves.

Many other implementations other than those described may be employed, and may be encompassed by the following claims.

What is claimed is:

1. An apparatus comprising:

an enclosure defining an acoustic volume, the enclosure capable of receiving a transducer for converting electrical signals into audible signals, the transducer having an external end that radiates the audible signals outward from the apparatus, and an opposite, internal end, wherein the acoustic volume is disposed adjacent to the internal end of the transducer;

at least two structures within the enclosure defining corresponding channels between the acoustic volume and an external surface of the enclosure, each channel having one end located within the enclosure and another end that terminates at the external surface of the enclosure; and an acoustic resistive element located on a wall shared by two adjacent structures of the at least two structures such that the channels corresponding to the two adjacent structures are on two sides of the acoustic resistive element, respectively, the acoustic resistive element configured to change acoustic characteristics of the channels corresponding to the two adjacent structures within the enclosure.

2. The apparatus of claim 1, wherein the acoustic resistive element allows air flow between the channels corresponding to the two adjacent structures.

3. The apparatus of claim 1, further comprising a second acoustic resistive element disposed in one of the channels corresponding to the two adjacent structures, wherein the second acoustic resistive element allows air flow between the corresponding channel and the exterior of the enclosure.

4. The apparatus of claim 1, further comprising a second acoustic resistive element disposed in one of the channels corresponding to the two adjacent structures, wherein the second acoustic resistive element allows air flow between the corresponding channel and the acoustic volume.

5. The apparatus of claim 1, wherein the acoustic resistive element is configured to change acoustical signatures of two ports that include the channels corresponding to the two adjacent structures.

6. The apparatus of claim 1, wherein the acoustic resistive element includes a single layer.

7. The apparatus of claim 1, wherein the acoustic resistive element includes multiple layers.

8. The apparatus of claim 1, wherein the acoustic resistive element includes a layer of fabric material.

9. The apparatus of claim 1, wherein the acoustic resistive element includes a metallic mesh.

10. The apparatus of claim 1, wherein the acoustic resistive element is generally rectangular in shape.

11. The apparatus of claim 1, further comprising a second acoustic resistive element disposed in one of the channels corresponding to the two adjacent structures, and a third acoustic resistive element disposed in the other of the channels corresponding to the two adjacent structures wherein the second acoustic resistive element allows air flow between the corresponding channel and the acoustic volume, and the third acoustic resistive element allows air flow between the corresponding channel and the acoustic volume.

12. The apparatus of claim 1, further comprising a second acoustic resistive element disposed on a wall of the enclosure, wherein the second acoustic resistive element allows air flow between the interior and the exterior of the enclosure.

13. An apparatus comprising:

a transducer for converting electrical signals into audible signals, the transducer having an external end that radiates the audible signals outward from the apparatus, and an opposite, internal end;

an enclosure that supports the transducer and includes an acoustic volume disposed adjacent to the internal end of the transducer;

at least two structures within the enclosure defining corresponding channels between the acoustic volume and an external surface of the enclosure, each channel having one end located within the enclosure and another end that terminates at the external surface of the enclosure; and an acoustic resistive element located on a wall shared by two adjacent structures of the at least two structures such that the channels corresponding to the two adjacent structures are on two sides of the acoustic resistive element, respectively, the acoustic resistive element configured to change acoustic characteristics of the channels corresponding to the two adjacent structures within the enclosure.

14. The apparatus of claim 13, wherein the acoustic resistive element allows air flow between the channels corresponding to the two adjacent structures.

15. The apparatus of claim 13, further comprising a second acoustic resistive element disposed in one of the channels corresponding to the two adjacent structures, wherein the second acoustic resistive element allows air flow between the corresponding channel and the exterior of the enclosure.

16. The apparatus of claim 13, further comprising a second acoustic resistive element disposed in one of the channels corresponding to the two adjacent structures, wherein the second acoustic resistive element allows air flow between the corresponding channel and the acoustic volume.

17. The apparatus of claim 13, wherein the acoustic resistive element is configured to change acoustical signatures of two ports that include the channels corresponding to the two adjacent structures.

18. The apparatus of claim 13, wherein the acoustic resistive element includes a single layer.

19. The apparatus of claim 13, wherein the acoustic resistive element includes multiple layers.

20. The apparatus of claim 13, wherein the acoustic resistive element includes a layer of fabric material.

21. The apparatus of claim 13, wherein the acoustic resistive element includes a metallic mesh.

22. The apparatus of claim 13, wherein the acoustic resistive element is generally rectangular in shape.

23. The apparatus of claim 13, further comprising a second acoustic resistive element disposed on a wall of the enclosure, wherein the second acoustic resistive element allows air flow between the interior and the exterior of the enclosure.

24. The apparatus of claim 13, wherein a first structure of the at least two structures within the enclosure share a common wall with the acoustic volume, and a second acoustic resistive element disposed on the common wall allows air flow between the acoustic volume and the first structure.

25. The apparatus of claim 24, wherein a third acoustic resistive element disposed on a wall of a second structure of the at least two structures allows air follow between the second structure and an exterior of the apparatus.

* * * * *